United States Patent [19]

Odorici

[11] Patent Number: 4,708,568

[45] Date of Patent: Nov. 24, 1987

[54] APPARATUS FOR SUPPLYING FLATTENED BOXES TO A PACKAGING MACHINE

[75] Inventor: Franco Odorici, Gaggio Montano, Italy

[73] Assignee: Azionaria Construzioni Macchine Automatiche-A.C.M.A. S.p.A., Bologna, Italy

[21] Appl. No.: 863,631

[22] Filed: May 15, 1986

[30] Foreign Application Priority Data

May 16, 1985 [IT] Italy ..... 3445 A/85

[51] Int. Cl.[4] ..... B65H 1/26

[52] U.S. Cl. ..... 414/330; 271/31.1; 271/149; 271/157

[58] Field of Search ..... 271/31.1, 149, 150, 271/157, 158, 159; 414/330

[56] References Cited

U.S. PATENT DOCUMENTS 2,291,010 7/1942 Vergobbi ..... 271/150 X 2,720,394 10/1955 Ferguson ..... 271/150

4,052,052 10/1977 Müller ..... 271/157

*Primary Examiner*—Richard A. Schacher

*Attorney, Agent, or Firm*—Cohen, Pontani & Lieberman

[57] ABSTRACT

A supply device for supplying flattened boxes (1) to a packaging machine, equipped for the re-supply of the boxes (1), comprising apparatus for feeding a line (4) of boxes along a magazine (2) including a front carriage (13) and a rear carriage (14) feed chains (6, 8), flat vertical slides (19, 27) for connecting the carriages (13, 14) to the feed chains (8), a double action pneumatic jack (42) for sliding the carriages (13, 14) towards or away from one another, a plate (31) mounted on the carriage (13) moveable transversely between a position facing the line (4) and a retracted position, a plate (41) on the carriage (14) facing and normally spaced from the plate (31) to form a space containing additional boxes (1). To supply the additional line (46) of boxes, the plate (41) is first moved to compact the additional line (46) and thereafter plate (31) is retracted to provide a single line of boxes. The plate (31) is then moved adjacent the plate (41) and returned to apply pressure to the rear of the line comprising the original (4) and additional (46) boxes.

7 Claims, 11 Drawing Figures

APPARATUS FOR SUPPLYING FLATTENED BOXES TO A PACKAGING MACHINE

FIELD OF THE INVENTION

The present invention relates to a supply device for supplying flattened boxes to packaging machines and is suitably equipped to be re-supplied with these boxes.

BACKGROUND TO THE INVENTION

Boxes of cardboard or other sheet material, which are to be processed in packaging machines, are commonly prepared in a flattened tubular form. They are then folded such that their side surfaces and flaps projecting from these surfaces intended to form the ends of the box lie on one or other of the two planes adjacent to one another. Boxes flattened in this way are arranged in a line in a magazine provided in known feeding devices for the packaging machines. The magazine is defined at the front by a fixed support face and at the rear by a plate which may be moved towards this face; by means of suitable pressure the line of boxes stored is held against support members defining this face. Suction members, disposed between the face and the packaging machine, operate in the machine cycle to extract a flattened box from the support members and, with suitable assistance, unfold and open the box into a tubular, prismatic form and insert it in the machine. To keep the boxes of the magazine constantly adjacent to the support face whilst they are being progressively extracted, they are supported by feed means, in practice of the chain type, which move towards the face in a suitable timed relationship with the packaging machine and are held at the rear by the plate which is detachably connected to the feed means.

Obviously the supply device must be filled with new boxes at certain intervals. The re-supplying operation usually involves an additional line of boxes being disposed behind the plate, in a space of the magazine defined between the main plate and a secondary rear plate, as a result of which there is formed a detachable connection with the feed means of the supply device. Consequently, by manual operation, the main plate is either detached from the feed means or removed from the position in which it faces and contacts the boxes. The secondary plate, after being suitably connected to the said means, replaces the main plate and acts on either the new or the old boxes. The main plate is then manually retracted and, immediately in front of the secondary plate, is caused to return to the position in which it faces and contacts the boxes and is connected to the feed means. The secondary plate is finally detached from these means, this plate being retracted to form the said space again.

During the operation for re-supplying the boxes, it is difficult to ensure the maintenance of the pressure required for the efficient removal of the boxes by the suction means. Moreover, the various operations require particular skills and are exacting and difficult particularly if carried out by a single employee.

OBJECTS OF THE INVENTION

An object of the present invention is therefore to provide supply devices for flattened boxes in which for re-filling these devices, manual operation is no longer required, and constant mechanical efficiency is ensured for the removal of these boxes.

A further object is to provide an improved supply device for flattened boxes which is simply constructed, operates reliably and is economically advantageous to use.

SUMMARY OF THE INVENTION

The invention provides, in one aspect, a supply device for supplying flattened boxes to a packaging machine equipped so that it may be re-supplied with these boxes, comprising a magazine for a line of boxes which is bounded at the front by a support face and comprises reed means which supports the line of boxes, and which moves longitudinally relative to the magazine in cooperation with means of the packaging machine, a front carriage and a rear carriage mounted to slide longitudinally relative to the magazine, clamp means mounted on each carriage which may be respectively actuated to connect them to the feed means, wherein the clamp means of the front carriage is normally operative and the clamp means of the rear carriage is normally inoperative, operating means disposed between the carriages which may be actuated so that the carriages slide in the longitudinal manner towards or away from one another, the operating means normally being inoperative and the carriages spaced from one another, a main plate displaceably mounted on the front carriage which may be moved transversely between a first position in register with the line of boxes and a second remote position, the main plate normally being in the first position and acting such that it forms a rear boundary for the line of boxes, a secondary plate is mounted on the rear carriage so as to face the main plate, the secondary plate normally being remote from the main plate so as to define with the latter a space for containing an additional supply of boxes, the secondary plate comprising a recess bounded by edges at the front so that the plate and the edges bound the additional supply at the rear and so constructed and arranged as to be intersected by the main plate and arranged to receive the main plate in its recess, and controls of the clamp means and operating means and controls for the main plate, the controls being coordinated in such a way that once the additional supply has been provided, the operating means causes the secondary plate to slide longitudinally towards the main plate so as to move the additional supply of boxes closer together and to make it more compact, the clamp means of the rear carriage is actuated, the clamp means of the front carriage is deactuated and the main plate is moved into its second position, the secondary plate thereafter acting on both lines of boxes, the operating means continuing to move the main plate and secondary plate towards one another until the main plate reaches the secondary plate, the main plate then being returned to its first position, received in the recess in the secondary plate, the clamp means of the front carriage then being reactuated and the clamp means of the rear carriage deactuated and the operating means causing the carriages to slide apart.

BRIEF DESCRIPTION OF THE DRAWINGS

There now follows a detailed description, to be read with reference to the accompanying drawings, of a supply device embodying the invention. It will be realised that this device has been selected for description to illustrate the invention by way of example.

In the accompanying drawings.

DESCRIPTION OF THE PREFERRED EMBODIMENT

Figure 1:
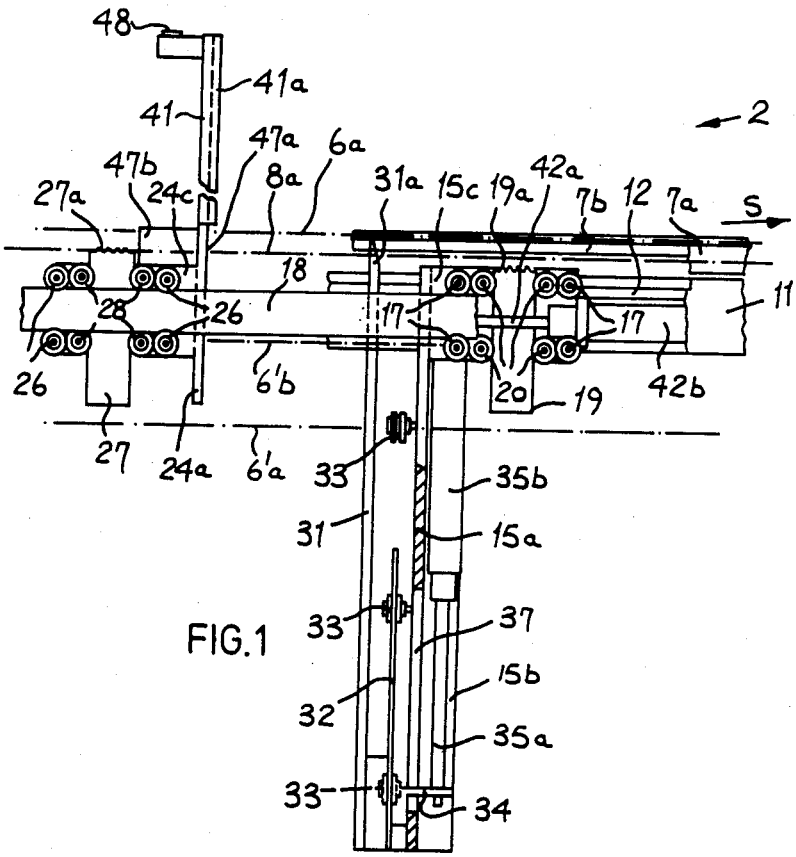
FIGS. 1 and 2 are respectively elevation and plan views of the supply device embodying the invention, with some parts removed.
Figure 2:
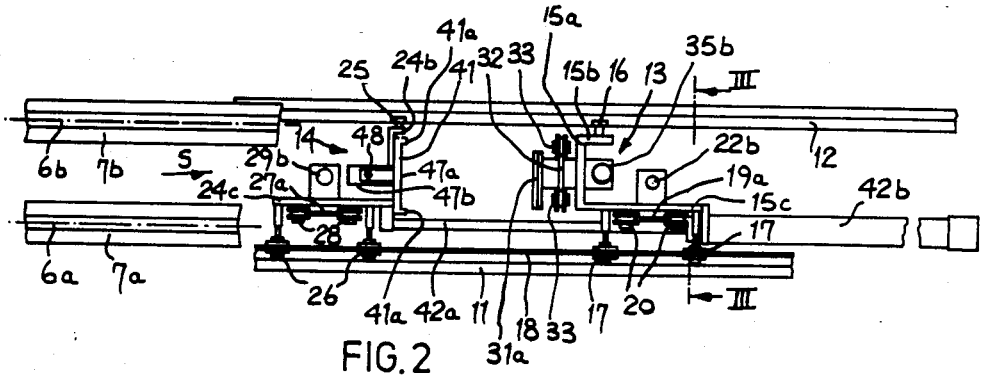

The supply device embodying the invention is intended for supplying flattened boxes 1 to packaging machines and is constructed so that it may be re-supplied with these boxes. It comprises a magazine 2 for the boxes which is bounded at the front by a support face defined in a known manner by abutment members 3 against which there is normally held a line 4 of these boxes. Between the support face and the inlet of the packaging machine there operate, in a known manner, feed means of the packaging machine comprising suction devices 5 which remove, when required, the front box of the line 4 from the members 3 and, with suitable assistance, open the box into a tubular prismatic shape.

Figure 3:
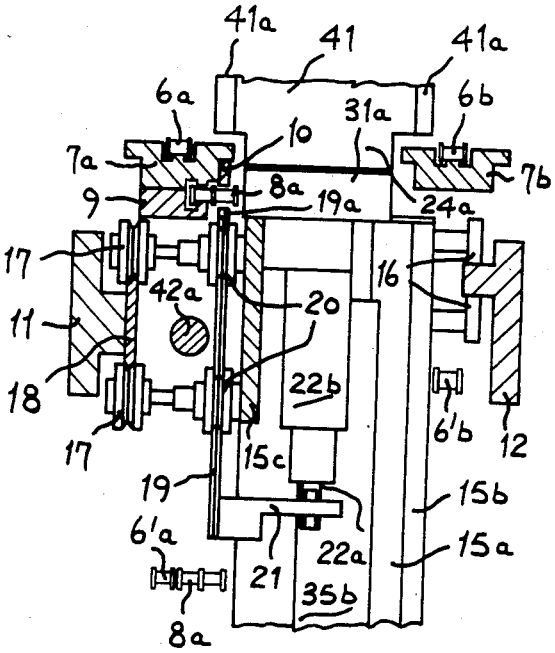
FIG. 3 is a partial vertical cross-section of the supply device along the line III of FIG. 2 and enlarged with respect to FIG. 2.
Figure 10:
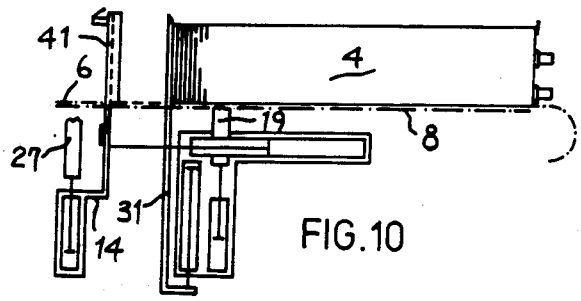
FIGS. 6 to 10 are elevation views showing the operating sequence of the supply device.

With reference to FIGS. 1 and 3, it can be seen that the base of the magazine 2 is bounded by a pair of first feed means provided by upper operative branches 6*a–b* of a pair of chains of the closed circuit type, and which at the ends of the magazine 2 pass round toothed, drive and return wheels (not shown). The two branches 6*a–b* of the first feed means 6 are guided and supported in a channel formed in two associated profiled sections 7*a–b* extending horizontally and in turn support the line of boxes 4. The branches 6*a–b* move in the direction of the arrow S, i.e. towards the support face with a speed appropriate to that of the feed means of the packaging machine. The lower return branches 6'*a–b* correspond to the operational branches 6*a–b*. Second feed means 8, of the double chain and closed circuit type, comprise an upper operational branch 8*a* and a return branch 8'*a*. The operational branch 8*a* is slightly below and parallel to the branch 6*a*, and moves at the same speed as the branch 6*a*. Part of the double chain of the branch 8*a* is guided and supported in a sort of channel formed laterally between the profiled section 7*a* and a profiled section 9 disposed therebelow. The remainder projects from this lateral channel and abuts at the top against a strip 10 fixed along the profiled section 7*a*.

Below the profiled sections 7*a–*9 and 7*b* are beams 11 and 12 parallel to these sections. Between the beams are disposed two carriages 13 and 14 which are slidably guided along these beams. The front carriage 13 comprises a vertical profiled section with an L-shaped section. A flange 15*a* of the L is transverse to the beams 11 and 12 and to the supply device, whilst a flange 15*b* is parallel thereto and adjacent to the beam 12. At a top portion of the vertical profiled section, the flange 15*b* supports a pair of rollers 16 which engage above and below a longitudinal rib in the beam 12 and are provided with respective roll tracks therein. Also at this top portion a vertical plate 15*c* which is close and parallel to the beam 11 projects from the flange 15*a* and, in the same way as the flange 15*b*, faces forwardly. Near corners of the plate 15*c* wheels 17 are mounted for rotation outwardly of the plate 15*c* and engage therefrom. The wheels 17 have a shaped groove and engage with correspondingly shaped upper and lower edges of a strip 18 which is fixed to a longitudinal internal rib of the beam 11. The wheels 11 and the rollers 16 have horizontal axes transverse to the supply device and enable the front carriage 13 to slide longitudinally. This sliding movement normally takes places because the carriage 13 is connected to the branch 8*a* of the second feed means, although, as will be explained below, the carriage may slide independently of these means and is, in that case, detached therefrom. In order to connect the carriage 13 to the branch 8*a* there is provided clamp means including an anchoring member, namely a flat vertical slide 19 parallel to the plate 15*c*. Vertical edges of the slide 19 are shaped and engaged in the grooves of four wheels 20 rotatably mounted on the plate 15*c* in a similar way to the wheels 17, although they are closer together in the horizontal direction and adjacent to the plate 15*c*. The upper edge of the slide 19 forms a rack 19*a* intended to engage the projecting portion of the double chain of the branch 8*a* which abuts the strip 10. To effect vertical reciprocating movement, the slide 19 has at its base a bracket 21 connected to a movable portion, namely the rod 22*a* of a double action pneumatic jack 22. At the top the cylinder 22*b* of the jack is fixed to the inner face of the plate 15*c* and the rod 22*a* projects from the cylinder 22*b* at the bottom (FIGS. 3 and 4).

In the diagrams of FIGS. 6 to 10, for simplicity of illustration, the rod is shown projecting towards the top. In any case, the actual representation and the simplified illustration give the same significance to the upper chamber 23*a* and the lower chamber 23*b* which are separated by the piston in the cylinder 22*b*. In fact when the chamber 23*b* is under pressure, the slide 19 is at the top and connects the front carriage to the branch 8*a* whereas, when the pressurised air reaches the chamber 23*a*, the slide 19 moves downwardly and releases the carriage from the branch. The same applies to the carriage 14: rollers 25, a plate 24*c* and wheels 26 correspond to the rollers 16, and the plate 15*c* and the wheels 17; a slide 27, a rack 27*a*, wheels 28, a cylinder 29*b* and chambers 30*a* and 30*b* of a jack 29 correspond respectively to the slide 19, the rack 19*a*, the wheels 20, the cylinder 22*b* and the chambers 23*a* and 23*b* of the jack 22. In normal operation (FIG. 6) the slide 19 is at the top and the slide 27 at the bottom.

Figure 4:
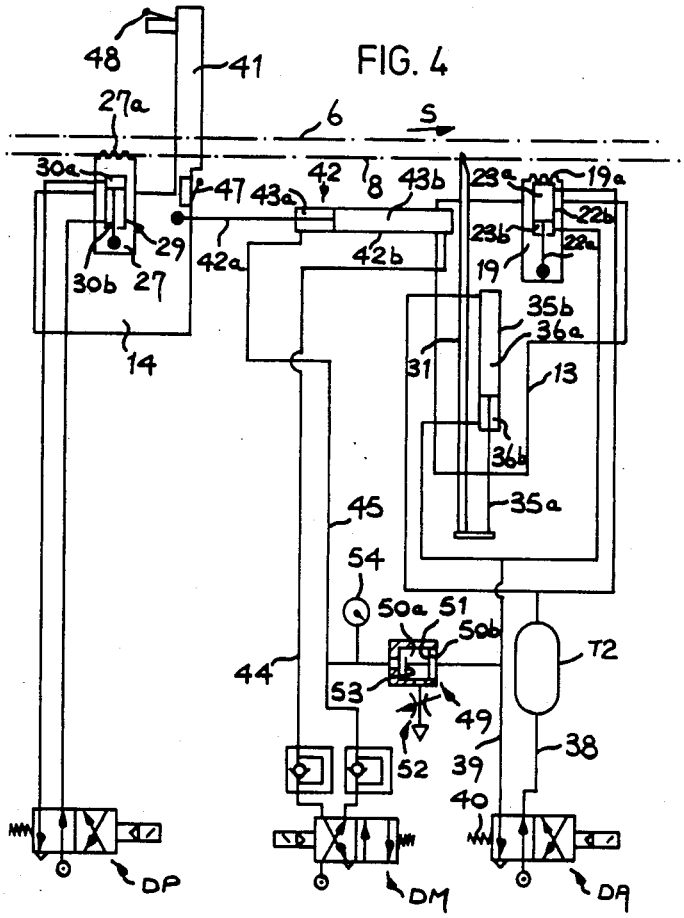
FIG. 4 is a view of a pneumatic system of the supply device.

A vertical main plate 31 is mounted on the front carriage 13 such that it may be displaced between a normal position in which (FIGS. 6, 9 and 10) the plate is disposed such as to intersect the magazine 2 and to bound the line of boxes 4 at the rear, and a second retracted position (FIGS. 1, 3, 4 and 8). The plate 31 is parallel with and to the rear of flange 15*a* and has its apex 31*a* bevelled at the front to provide a lead-in. The plate 31 slides vertically and has fixed to its base the base of a parallel vertical strip 32 which is not as high as the plate 31 and is disposed between the latter and the flange 15*a*. Vertical edges of the strip 32 are, or may be, engaged by a series of grooved wheels 33 rotatably mounted on the said flange. The bases of the strip 32 and the plate 31 are connected via a bracket 34 to the rod 35*a* of a double action pneumatic jack 35 whose cylinder 35*b* is fixed at its upper end portion to the flange 15*a* and is divided internally into an upper chamber 36*a* and a lower chamber 36*b*. The cylinder is fixed to the front of the flange 15*a* and the bracket 34 passes through a vertical slot 37 in the flange. The chambers 36*a* and 23*a* of the cylinders 35*b* and 22*b* respectively communicate (FIG. 4) with a single conduit 38. The same applies to the lower chambers 36*b* and 23*b* whose single conduit is shown by 39. The chambers 36*a* and 23*a* are alternately pressurised or discharged via a valve DA having two positions, which is solenoid operated and which moves into one position when, as will be explained, it is excited, whereas it is returned to the other position by a spring 40. As shown in FIG. 4, when the valve DA is not excited the chambers 23*a* and 36*a* are pressurised and the main plate 31 and the rack 19*a* are in their lowest position.

A valve DP, similar to DA, alternately pressurises or discharges the chamber 30*a* and the chamber 30*b* of the jack 29 arranged to actuate the clamp means of the rear carriage 14. As shown in FIG. 4, when DP is disexcited, the chamber 30*b* is pressurised and the rack 27*a* is in its highest postion and is connected to the feed means 8. In addition to the plate 24*c*, the rear carriage 14 comprises a plate 24*a* which is perpendicular and to the front of the previous plate and a projection 24*b* on which the rollers 25 are slidably mounted. The plate 24*a* extends upwardly into a second plate 41 which is wider than the plate 24*a* and projects above the branches 6*a–b* of the first feed means and forms at the front a recess defined by the raised vertical edges 41*a*. Between the two carriages 13 and 14 there is interposed actuation means viz. an actuation device which may be actuated so as to cause the carriages to slide longitudinally and reciprocally. This actuation device is formed by a pneumatic jack 42 of the double acting type whose axis is horizontal and longitudinal with respect to the supply device. The rod 42*a* of the jack is connected to the plate 24*c* of the rear carriage and its cylinder 42*b* is detachably supported by a projection of the plate 15*c* of the front carriage. The jack 42 is normally (FIG. 6) in the position of maximum extension with its chamber 43*b* pressurised via the conduit 44 and its chamber 43*a* discharged via the conduit 45. Consequently the two carriages 13 and 14 and the two plates 31 and 41 are spaced such that a space is defined therebetween and such that a line of boxes 46 supplementing the line 4 already present in the store 2 may be loosely arranged in this space and on the branches 6*a–b*. The chambers 43*a* and 43*b* are alternately pressurised by the electrical valve DM which is similar to the previous valve and when excited (as in FIG. 4) causes the chamber 43*a* to be supplied with pressurised air. In this way, as will be shown below, the carriage 13 moves closer to the carriage 14 and the main plate 31 abuts against the plate 24*a* and acts on a sensor 47. As it is inserted in a bore passing through the plate 24*a*, the sensor element 47*a* of the sensor is in fact accessible from the front of the plate 24*a*, whereas the body 47*b* of the sensor is attached at the rear of the plate 24*a*.

To begin the cycle in which further boxes are supplied, a manual push-button 48 is provided fixed to the upper rear portion of the second plate 41. Along the conduit 38 is disposed a pneumatic accumulator T2 which, as will be shown below, acts as a timer. Between the conduits 39 and 45 is disposed a differential valve device 49 by means of which a selective supply of the chamber 43*a* of the jack 42 is carried out. The device comprises a cylinder whose interior is divided into two chambers 50*a* and 50*b* by a piston 51. The chamber 50*b* is in permanent communication with the conduit 39 and the chamber 50*a* is permanently discharged via an adjustable throttle 52 and has its communication port with the conduit 45 which is normally closed by a shutter 53 connected to the piston 51 by a rod. The pressure in the conduit 45 and in the chamber 43*a* can be detected by the instrument 54 which supplies information for use in the regulation of the throttle 52.

Figure 11:
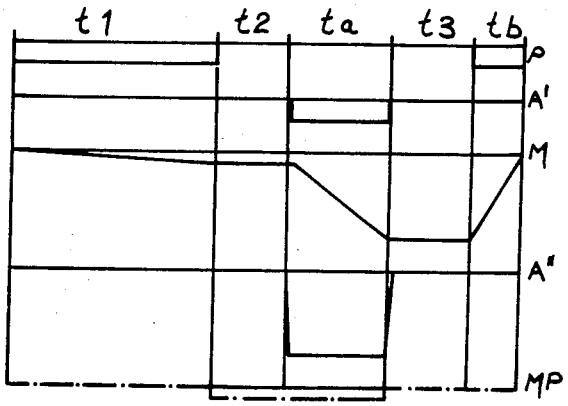
FIG. 11 shows in diagram form operational stages of elements of the supply device.
Figure 5:
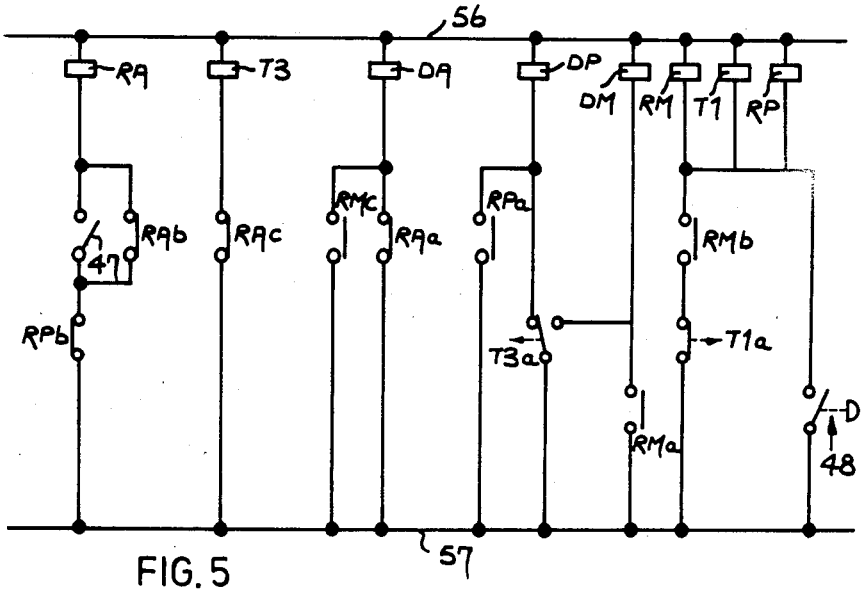
FIG. 5 is an electrical diagram of the device.
Figure 6:
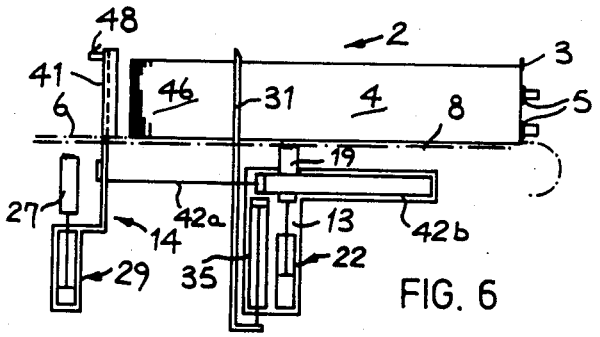

The electrical circuit of the supply device is described with reference to FIG. 5 which shows it in a normal operating condition. Between a pair of conductors 56 and 57 providing the electrical supply line, there are disposed in parallel two timer relays T1 and T3, the above-mentioned solenoid valves DA, DP and DM and corresponding relays RA, RP and RM which, in their operating condition, keep the contacts RAa, RPa and RMa closed and therefore keep the respective valves excited. By operating the push-button contact 48, the relays RP, T1 and RM are brought into operation and are kept operative, by the closure of the contact RMb effected by the relay RM, until the contact T1a opens, this contact being operated by the timer T1 and having a delayed opening. When RP and RM are operative, the contacts RP and RMc are, however, respectively open and closed and consequently DA is excited via the latter contact. When the contact 47 is closed, RA is brought into operation via the closed contact RPb which also causes the closure of the self-maintaining contact RAb and the contact RAc. The timer T3 is brought into operation via RAc, the switch T3a depending on this timer. With a certain delay T3 (FIG. 11) the switch is displaced to the left which means that it no longer excites DM but DP.

With reference finally to FIGS. 6 to 11, the operation of the supply device is now described. Under normal conditions (FIG. 6), as mentioned above, the relays RA and T3 are in operation and consequently the valves DA and DP are excited and DM is not excited. Consequently the chambers 23*b*, 36*b*, 50*b*, 30*a* and 43*b* are under pressure. The rack 19*a* and the main plate 31 are raised and the shutter 53 is closed, the rack 27*a* is lowered and the carriages 13 and 14 are spaced and consequently the plates 31 and 41 are spaced. In this situation, the carriage 13 and the plate 31 are directly connected to the second feed means 8 to which the carriage 14 and the secondary plate 41 are moreover indirectly connected, i.e. via the jack 42. The feed means 8 and the main plate 31 connected thereto keep the line of boxes 4 adjacent to the support face 3 moving, in the direction S, progressively towards this face in accordance with the number of boxes which the suction devices 5 progressively remóve from this face. This is the situation at the beginning of the cycle for the re-supply of the boxes and which is shown overall in FIG. 11 at the beginning of the time interval t1. An entire re-supply cycle is formed by the sum of the consecutive time intervals t1, t2, ta, t3 and tb. As a function of these intervals, the broken lines P, A′ and A″ of FIG. 11 relate respectively to the alternating vertical displacements of the rear rack 27*a*, the front rack 19*a* and the main plate 31 also at the front. The line M relates to the jack 42 which is retracted or extended, and therefore relates to the reciprocal sliding apart or together of the carriages 13 and 14. The broken line Mp relates finally to the pressure curve of the air supplying chambers of the jack 42.

Figure 7:
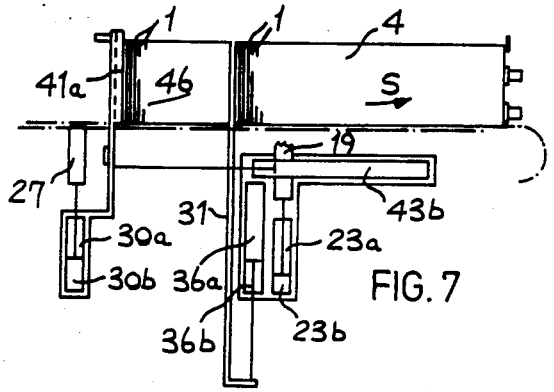
Figure 8:
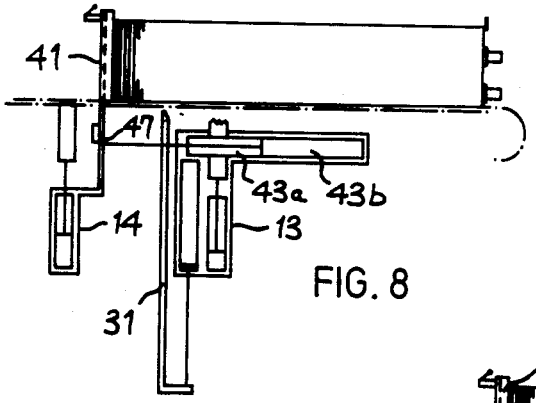
Figure 9:
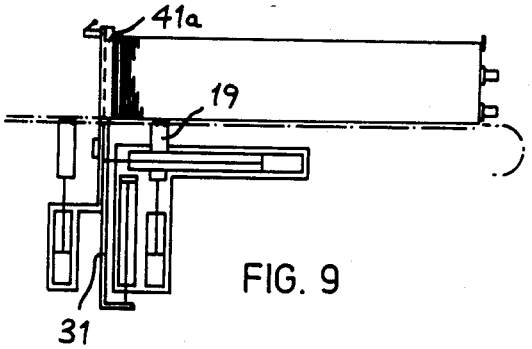

Before the cycle for the re-supply of the boxes is initiated, an additional line of boxes 46 is suitably arranged in the space between the plates 31 and 41. This cycle is initiated by momentarily closing the contact 48 and therefore bringing into operation the relays RM, RP and T1 which, by closing the contact RMb, remain operative for the entire interval t1 dependent on T1. Although the relays RA and T3 become inoperative as a result of the opening of the contact RPb and therefore the contact RAa opens and the switch T3a is displaced to the right, the solenoid valves DA and DP continue to remain excited as a result of the closure of the contact RMc and RPa. In conclusion the main effect of the actuation of the push-button 48 is to excite the solenoid valve DM of the jack 42 via the contact RMa which is closed and thus displaced via the switch T3a. In the jack 42 the chamber 43*a* is therefore pressurised and the chamber 43*b* discharged, whilst the shutter 53 remains closed since a force lower than that acting on the piston 51 is acting on it. In the interval t1 there is therefore an initial retraction of the jack 42 and an initial moving together in the direction S of the carriage 14 and the plate 41 to the rear of the carriage 13 and the plate 31 at the front. Consequently the boxes of the additional line 46 are closed up by the edges 41*a* of the plate 41 against the plate 31 as shown in FIG. 7.

At the end of t1, the contact T1a opens and RP, T1 and RM are brought into the rest condition. The various contact of the electrical circuit are either already open or begin to open. Only T3a is closed to the right and RPb closes. DA and DP are disactivated whilst DM remains excited. The immediate consequence of this disactivation is that the chambers 23*b*, 36*b*, 50*b* and 30*a* are discharged and the chamber 30*b* is pressurised. The rear rack 27*a* is immediately connected to the feed means 8 to which the front rack 19*a* is still connected. The shutter 53 opens immediately reducing the supply to the chamber 43*a* of the jack 42 and consequently there is a stoppage in the retraction of the jack.

At the end of the interval t1, the lowering of the plate 31 and the rack 19*a* cannot take plate immediately as a result of the fact that the pneumatic accumulator is present in the conduit 38 which is connected to the pressurised air. The accumulator delays this lowering operation for the interval t2 which follows t1. However at the end of t2 (FIG. 7), the lowering takes place and there is no obstacle to the removal of the plate 31 from the adjoining lines 4 and 46 of boxes. It is consequently the edges 41*a* of the rear plate 41 which take the place of the plate 31 and act so as to provide a rear boundary for the assembly of the two lines 4 and 46. During ta, the pause in the action of the jack 42 has ceased and it comes into action again (FIGS. 4 and 8) and completes its retraction. The front carriage 13, moving in the opposite direction to S, moves closer to the carriage 14 until the plate 31 contacts the plate 24*a* and closes the contact 47. It should be noted that the opening of the valve 49 is useful not only in the stages in which both the racks 27*a* and 19*a* are connected to the feed means 8 and in which the main plate 31 is removed from the boxes and the front rack 19*a* is disconnected, but also to absorb the impact of the plate 31 on the plate 24*a*.

The closure of the contact 47 brings the relay RA and therefore the timer relay T3 into operation. The contact RAa is closed and the distributor DA is excited. The rack 19*a* and the main plate 31 are raised, the main plate (FIG. 9) intersecting the secondary plate and being housed in the front recess of the latter defined by the edges 41*a*. The shutter 53 stops communication between the conduit 45 and the controlled discharge 52. Obviously, the jack 42 which was retracted as far as possible remains in this position.

At the end of the interval t3, caused by T3, the switch T3a is displaced and disactivates the solenoid valve DM and resets the excitation of the solenoid valve DP. This causes immediate lowering of the rear rack 27*a*, whilst the jack 42 is rapidly extended and, moving in the opposite direction to S, the rear carriage 14 (FIG. 10) spaces the plate 41 from the plate 31. The latter plate is brought back into normal operation. At the end of the time interval tb, the jack 42 reaches its maximum extension and the space for the arrangement of a new line 46 of boxes is again provided between the two plates. The electrical circuit also returns to its initial condition. In fact when the plates are spaced, the contact 47 re-opens and the relays RA and T3 remain in operation, as the self-maintaining contact RAb is closed.

Having thus described my invention, what I claim as new and desire to secure by letters patent of the United States of America is:

1. A supply device for supplying flattened boxes to a packaging machine equipped so that it may be re-supplied with these boxes, comprising a magazine for a line of boxes which is bounded at the front by a support face and comprises feed means which supports the line of boxes, and which moves longitudinally relative to the magazine in cooperation with feed means of the packaging machine, a front carriage and a rear carriage mounted to slide longitudinally relative to the magazine, clamp means mounted on each carriage which may be respectively actuated to connect them to the feed means, wherein the clamp means of the front carriage is normally operative and the clamp means of the rear carriage is normally inoperative, operating means disposed between the carriages which may be actuated so that the carriages slide in a longitudinal manner towards or away from one another, the operating means normally being inoperative and the carriages spaced from one another, a main plate displaceably mounted on the front carriage which may be moved transversely between a first position in register with the line of boxes and a second remote position, the main plate normally being in the first position and acting such that it forms a rear boundary for the line of boxes, a secondary plate is mounted on the rear carriage so as to face the main plate, the secondary plate normally being remote from the main plate so as to define with the latter a space for containing an additional supply of boxes, the secondary plate comprising a recess bounded by edges at the front so that the plate and the edges bound the additional supply at the rear and so constructed and arranged as to be intersected by the main plate and arranged to receive the main plate in its recess, and controls of the clamp means and operating means and controls for the main plate, the controls being coordinated in such a way that once the additional supply has been provided, the operating means causes the secondary plate to slide longitudinally towards the main plate so as to move the additional supply of boxes closer together and to make it more compact, the clamp means of the rear carriage is actuated, the clamp means of the front carriage is deactuated and the main plate is moved into its second position, the secondary plate thereafter acting on both lines of boxes, the operating means continuing to move the main plate and secondary plate towards one another until the main plate reaches the secondary plate, the main plate then being returned to its first position, received in the recess in the secondary plate, the clamp means of the front carriage then being reactuated and the clamp means of the rear carriage deactuated and the operating means causing the carriages to slide apart.

2. A supply device according to claim 1 comprising a first timer providing commands to define the interval of time in which the operating means causes the initial sliding together and, at the end of this interval, to initiate actuation of the clamp means of the rear carriage, a second timer following the first and providing commands to delay both the command to deactuate the clamp means of the front carriage and the command to displace the main plate into its second position, a sensor which detects when the main plate has reached the vicinity of the secondary plate and arranged to initiate actuation of the clamp means of the front carriage and the return of the main plate to its first position, a third timer actuated by the sensor and providing commands to delay both the command to deactuate the clamp means of the rear carriage and the command to operate the operating means to move the carriages apart.

3. A supply device according to claim 2 comprising a first pneumatic jack interposed between the front and rear carriages and normally in its extended position, corresponding to the spaced position of the carriages, and which has its appropriate chamber supplied selectively, during its retraction and the corresponding sliding together of the carriages, such that at the end of this initial sliding together the supply of the said chamber is restricted.

4. A supply device according to claim 3 wherein the main plate and the clamp means of the front carriage are connected to the moving parts of a second and a third double acting pneumatic jack respectively, the other parts of these jacks being connected to the front carriage and their chambers, intended to be supplied for the displacement of the main plate into the second position and for the deactivation of the clamp means of the front carriage, communicating with a single first conduit, whilst the other two chambers of the second and third jacks communicate with a second conduit, the clamp means of the rear carriage being provided by the moving part of a fourth jack connected to the rear carriage.

5. A supply device according to claim 4 wherein, between the second conduit and a further conduit which communicates with the selectively supplied chamber of the first jack, there is placed a differential valve device which, during the retraction of the jack and at the end of the initial sliding together, in order to reduce the supply to the said chamber, is arranged to bring the further conduit into communication with a controlled discharge, whilst a pneumatic accumulator is disposed along the first conduit and forms the second timer.

6. A supply device according to claim 5 wherein the first jack, the second and third jacks and the fourth jack are controlled by respective solenoid valves whose commands are supplied by a push-button for beginning the re-supply cycle, by the first and the third timers and by the sensor.

7. A supply device according to claim 4 wherein the main plate is moveable vertically between its first position, in which it is higher than and projects above the feed means, and its second, lower position and is mounted on the moving part of the second jack, whilst the secondary plate, projects above the feed means and has a lower portion on which a sensor is mounted.

* * * * *